US007237656B2

(12) United States Patent
Barrett et al.

(10) Patent No.: US 7,237,656 B2
(45) Date of Patent: Jul. 3, 2007

(54) ELEVATOR LOAD WEIGHING DEVICE

(75) Inventors: Dale Barrett, Berlin, CT (US); Nizar Dassouki, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 308 days.

(21) Appl. No.: 10/500,622

(22) PCT Filed: Feb. 28, 2002

(86) PCT No.: PCT/US02/06216

§ 371 (c)(1),
(2), (4) Date: Jul. 1, 2004

(87) PCT Pub. No.: WO03/074406

PCT Pub. Date: Sep. 12, 2003

(65) Prior Publication Data

US 2005/0087404 A1 Apr. 28, 2005

(51) Int. Cl.
*B66B 7/10* (2006.01)

(52) U.S. Cl. ..... 187/412; 187/393; 187/391; 248/183.3

(58) Field of Classification Search ..... 187/391, 187/393; 248/181.3
See application file for complete search history.

(56) References Cited

U.S. PATENT DOCUMENTS 3,610,342 A * 10/1971 Stainken ..... 177/147
4,793,442 A 12/1988 Heckler et al.
5,421,433 A 6/1995 Yoo
5,735,497 A * 4/1998 Haas et al. ..... 248/181.1
6,021,873 A 2/2000 Aulanko et al.
6,123,176 A * 9/2000 O'Donnell et al. ..... 187/393
6,315,084 B1 * 11/2001 Shon ..... 187/411
6,341,669 B1 * 1/2002 St. Pierre et al. ..... 187/412
6,435,316 B1 * 8/2002 Ando ..... 187/411

FOREIGN PATENT DOCUMENTS

JP 403098975 A 4/1991
JP 06-255933 9/1994

OTHER PUBLICATIONS

PCT International Preliminary Examination Report for PCT/US02/06216, dated Sep. 22, 2003.

* cited by examiner

*Primary Examiner*—Gene O. Crawford
*Assistant Examiner*—Stefan Kruer

(57) ABSTRACT

An improved measuring device for measuring the load of an elevator including a car suspended by a tension member within a hoistway, a termination (36) at one end of the tension member (28), a mounting plate (42) for attaching the termination relative the hoistway, and a hitch (38) for attaching the termination to the mounting plate further including load cell (56) positioned between the hitch and the mounting plate wherein the load cell generates a signal proportional to the load of the car

19 Claims, 2 Drawing Sheets

ELEVATOR LOAD WEIGHING DEVICE

TECHNICAL FIELD

This invention relates to a method and apparatus for measuring the load of an elevator car and more particularly for measuring the load at on each tension member.

BACKGROUND ART

U.S. Pat. No. 6,021,873 describes a load measurement device located at the dead end hitch. The tension member terminations are mounted to a bracket, which is in turn mounted to a plate. The plate is attached to a guiderail to fix the tension members relative to the hoistway. An edge flange is attached to the plate opposite the guiderails and a strain gauge is attached to the flange. The load exerted by the car suspended by the tension members is transmitted by the plate to the edge flange which is designed such that the force applied to the edge plate by the hoisting ropes causes a large deformation in the edge flange. The strain in the edge flange is measured by the strain gauge.

Japanese patent application 6-255933 describes a load measuring device located at the dead end hitch. The rope terminations pass through a lower plate fixed to a hoistway beam. The rope terminations are fixed to an upper plate, which is pivotally fixed to the lower plate. A load cell is positioned between the upper and lower plates. The load of the car is transmitted through the tension members, to the rope terminations, to the upper plate, forcing it to rotate toward the lower plate thus exerting a force on the load cell proportional to the weight of the car.

The prior art load measurement systems require not only mounting structure but also provisions for transferring the load from the mounting structure to the load measuring device.

The prior art also provides a measurement of the total load as opposed to the load on each tension member Therefore there exists a need for an improved simplified load measuring apparatus that eliminates the need for complex mounting provisions and provides load measurements for individual tension members.

DISCLOSURE OF INVENTION

The object of the invention is to provide an improved method and apparatus for measuring the load of an elevator.

A further object of the present invention is to provide a method and apparatus for measuring the load on each tension member of an elevator installation.

According to the present invention, a load weighing device for an elevator is located at the termination of a tension member for suspending the elevator car. A typical elevator system includes an elevator car and counterweight suspended by a tension member such as a steel or synthetic rope or flat belt. The tension member is driven by a machine to position the car and counterweight within a hoistway. The tension member is fixed within the hoistway at its first and second ends within the hoistway.

Terminations are fixed to the end of the tension member which are in turn attached to a structure such as a mounting plate or beam that is fixed relative the hoistway. The termination typically consists of a threaded rod which extends through an opening in the beam of mounting plate. A spring of buffer is placed over the rod. The spring is held in place between the beam and the end of the rod by a series of washers and nuts.

According to the present invention a load cell is fixed between the spring and an upper surface of the mounting plate and spring such that the load cell measures the weight borne by the tension member. For elevators having multiple tension members, there is a load cell for each tension member.

In a further embodiment of the present invention a self-aligning washer is fitted between the end of the spring and the load cell. This maintains the tension member in a position normal to the load cell to distribute the load evenly across the load cell.

BEST MODE FOR CARRYING OUT THE INVENTION

Figure 1:
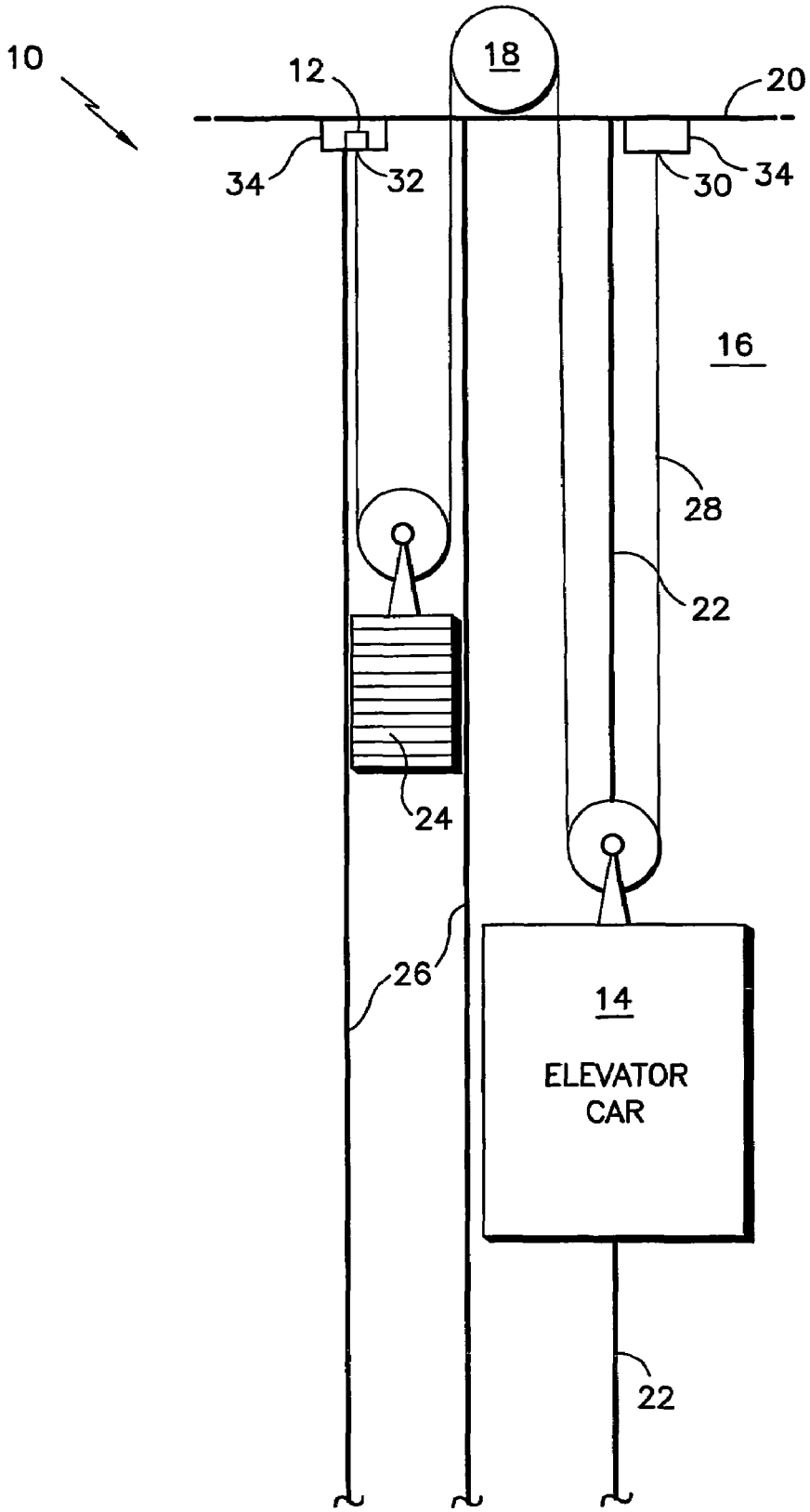
FIG. 1 is a schematic of an elevator installation according to the present invention.

According to the present invention, an elevator system 10 includes a load measuring device 12 as shown in FIG. 1. The elevator system includes 10 an elevator car 14, which is positioned within a hoistway 16 by a machine 18. The machine 18 is shown at the top of the hoistway 16 mounted on a machine beam 20. However, the exact location of the machine 18 is not critical to the operation of the load weighing device 12.

The car is guided within the hoistway on guide rails 22. A counterweight 24 serves to balance the load of the elevator car 14. The counterweight is guided within the hoistway on a second set of guide rails 26. Tension members 28 suspend the counterweight 24 and car 14. The tension members 28 are driven by the machine 18, which in turn controls the position of the car 14 and counterweight 24. The tension members 28 may consist of multiple ropes or flat belts.

Figure 2:
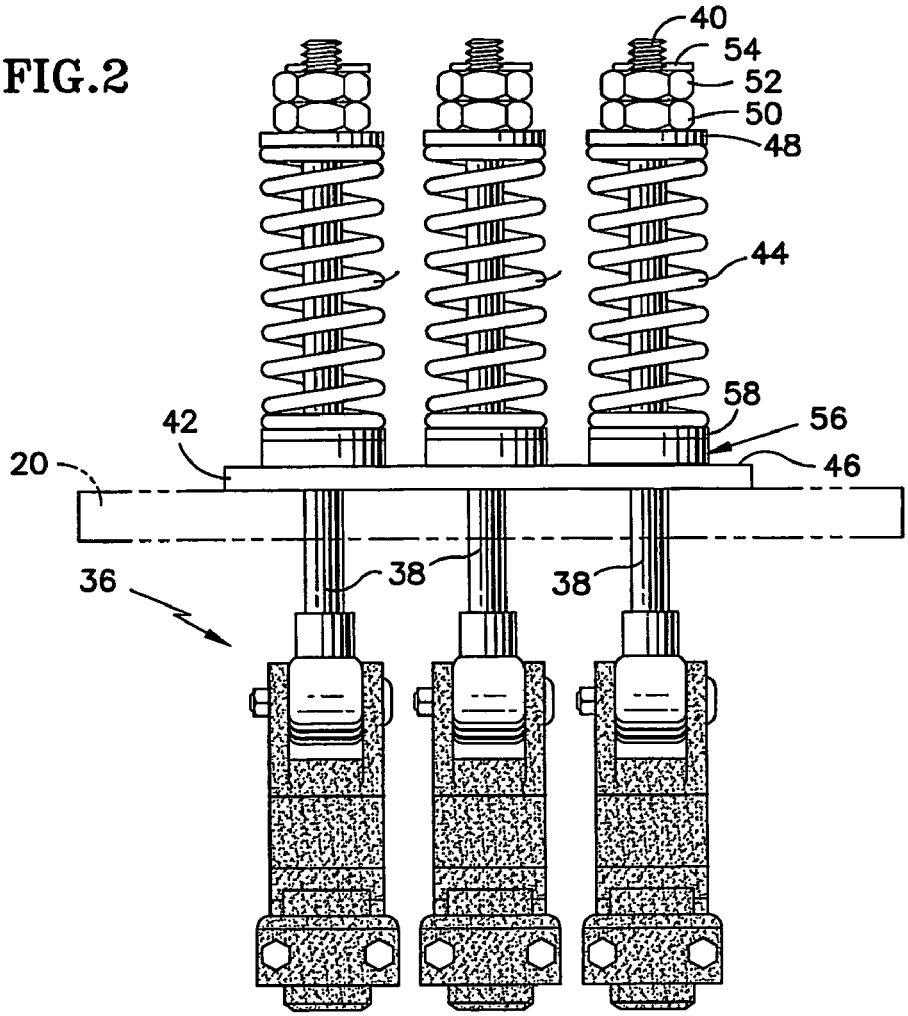
FIG. 2 is a plan view of a load weighing apparatus according to the present invention
Figure 3:
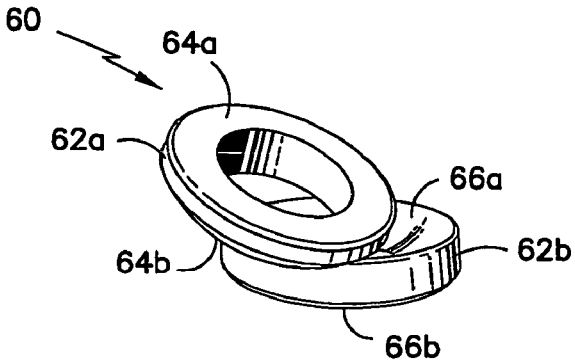
FIG. 3 is a plan view of the spherical washer.

The tension members 28 are usually fixed at a first 30 and second 32 end. An anchorage 34 incorporating the load measuring device 12 is shown in FIG. 2. The tension members 28 are attached to terminations 36. The terminations 36 include a rod 38 having a threaded end 40. The rod extends through a mounting plate 42 for attachment to a hitch.

The mounting plate 42 is designed for minimal deflection and may be fixed to a guiderail 22, machine beam 20, the wall of the hoistway, or any other structure suitable to support the weight of the car 14. In the alternative the mounting plate 42 may be eliminated and the terminations attached directly to the machine beam 20 or other suitable structure.

It is known in the art to fit a spring or buffer 44 over the rod 38. The spring 44 is held in place between the upper surface 46 of the mounting plate 42 and a washer 48 by a first nut 50, a lock nut 52 and cotter pin 54. According to the present invention a load cell 56 is located between spring 44 and the upper surface 46 of the mounting plate 42. A washer 58 is fitted between the load cell 56 and the spring 44 to evenly distribute the load over the load cell 56. The load cell 56 has an annular shape defining a hole through which the rod 38 passes.

A portion of the weight of the car 14, and its contents is borne by each tension member 28. This portion of the weight is sensed by the corresponding load cell 56, which is compressed between the spring 44 and upper surface 46 in proportion to the load.

The load cell 56 is conventional consisting of a bonded foil stranded and full bridge (not shown), which produces an electrical signal proportional to the load. The signal from each load cell 56 is summed together to obtain the total load. The signals may also be analyzed individually to determine the portion of the load carried by each tension member.

By measuring the load on each tension member 28, the springs 44 may be adjusted by either tightening or loosening the nuts 50 and 52 to equalize the load carried by each tension member 28. By measuring the load in each tension member 28, individually, any stretching of degradation of the tension members 28 can also be sensed as the loads carried by each tension member 28 varies over time.

In a second embodiment of the present invention a spherical washer 60 which consists of an upper portion 62*a* and a lower portion 62*b*. The upper portion has a flat upper surface 64*a* which interfaces with the spring 44 and convex lower surface 64*b* which interfaces with a concave upper surface 66*a* of the lower portion 62*b*. The lower portion 62*b* has a flat lower surface 66*b* which interfaces with the upper surface 46 of the mounting plate 42.

The interaction of the convex lower surface 64*a* and the concave upper surface 66*b* distributes the load evenly over the load cell 56. Even distribution of the load minimizes any errors that can occur detecting the load applied.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. A measuring apparatus for measuring the load of an elevator car suspended, within a hoistway, by a tension member that includes a termination at one end thereof, the apparatus comprising:

a mounting plate for attaching the termination relative to the hoistway;

a hitch for attaching the termination to the mounting plate;

a load cell positioned between the hitch and the mounting plate, the load cell being configured to generate a signal proportional to the load; and a self-aligning washer located between the hitch and the load cell, the self-aligning washer comprising a first portion interfacing with the load cell and a second portion interfacing with the hitch, wherein the first portion and second portion are configured to interface with each other to maintain the hitch in a position normal to the load cell.

2. The measuring apparatus of claim 1 wherein the load cell comprises an annular shape.

3. The measuring apparatus of claim 1 wherein the elevator car is configured to move along a guiderail positioned in the hoistway, and wherein the mounting plate is fixed to the guiderail.

4. The measuring apparatus of claim 1 further comprising:

a beam located at the top of the hoistway and attached to the mounting plate.

5. The measuring apparatus of claim 1 wherein the hoistway is defined by an elevator shaft and the mounting plate is attached to the elevator shaft.

6. The measuring apparatus of claim 1 wherein the first portion comprises one of a convex and concave surface for interfacing with a surface of the second portion, and wherein the surface of the second portion comprises the other one of a convex and concave surface.

7. The measuring apparatus of claim 4 wherein the termination is attached to the beam.

8. A measuring apparatus for measuring the load of an elevator including a car suspended, within a hoistway, by plurality of tension members each of which tension members includes a termination at one end thereof, the apparatus comprising:

a mounting plate for attaching the plurality of terminations relative to the hoistway;

a plurality of hitches for attaching each of the plurality of terminations to the mounting plate;

a load cell positioned between each of the plurality of hitches and the mounting plate wherein each load cell is configured to generate a signal proportional to the load; and a self-aligning washer located between each of the plurality of hitches and each load cell, each of the self-aligning washers comprising a first portion interfacing with the load cell and a second portion interfacing with the hitch, wherein the first portion and second portion of each self-aligning washer are configured to interface with each other to maintain the hitch in a position normal to the load cell.

9. The measuring apparatus of claim 8 wherein the elevator car is configured to move along a guiderail positioned in the hoistway, and wherein the mounting plate is fixed to the guiderail.

10. The measuring apparatus of claim 8 further comprising:

a beam located at the top of the hoistway and attached to the mounting plate.

11. The measuring apparatus of claim 8 wherein the hoistway is defined by an elevator shaft and the mounting plate is attached to the elevator shaft.

12. The measuring apparatus of claim 10 wherein the termination is attached to the beam.

13. An elevator system comprising:

an elevator car configured for movement within a hoistway;

a tension member that includes a termination at one end thereof; and a measuring apparatus for measuring a load of the elevator car suspended within the hoistway, by the tension member, the measuring apparatus comprising a mounting plate for attaching the termination relative to the hoistway;

a hitch for attaching the termination to the mounting plate;

a load cell positioned between the hitch and the mounting plate, the load cell being configured to generate a signal proportional to the load; and a self-aligning washer located between the hitch and the load cell, the self-aligning washer comprising a first portion interfacing with the load cell and a second portion interfacing with the hitch, wherein the first portion and second portion are configured to interface with each other to maintain the hitch in a position normal to the load cell.

14. The elevator system of claim 13, wherein the load cell comprises an annular shape.

15. The elevator system of claim 13, further comprising;

a guiderail positioned in the hoistway, wherein the elevator car is configured to move along the guiderail, and wherein the mounting plate is fixed to the guiderail.

16. The elevator system of claim 13, wherein the hoistway is defined by an elevator shaft, and wherein the mounting plate is attached to the elevator shaft.

17. The elevator system of claim 13, wherein the first portion comprises one of a convex and concave surface for interfacing with a surface of the second portion, and wherein the surface of the second portion comprises the other one of a convex and concave surface.

18. The elevator system of claim 13, further comprising:

a beam located at the top of the hoistway and attached to the mounting plate.

19. The elevator system of claim 18, wherein the termination is attached to the beam.

* * * * *